US009803519B2

(12) United States Patent
Kwon et al.

(10) Patent No.: US 9,803,519 B2
(45) Date of Patent: Oct. 31, 2017

(54) CONTINUOUS VARIABLE VALVE DURATION APPARATUS AND CONTROL METHOD USING THE SAME

(71) Applicant: Hyundai Motor Company, Seoul (KR)

(72) Inventors: Kiyoung Kwon, Yongin-si (KR); Ingee Suh, Yongin-si (KR); Kyoung Pyo Ha, Seoul (KR); In Sang Ryu, Hwaseong-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 259 days.

(21) Appl. No.: 14/724,372

(22) Filed: May 28, 2015

(65) Prior Publication Data

US 2016/0169057 A1 Jun. 16, 2016

(30) Foreign Application Priority Data

Dec. 10, 2014 (KR) ..... 10-2014-0177810

(51) Int. Cl.

| | |
|---|---|
| ***F01L 1/34*** | (2006.01) |
| ***F02D 13/02*** | (2006.01) |
| *F01L 1/344* | (2006.01) |

(52) U.S. Cl.

CPC ..... *F01L 1/34* (2013.01); *F02D 13/0226* (2013.01); *F02D 13/0238* (2013.01); *F01L 1/344* (2013.01); *F01L 2800/14* (2013.01)

(58) Field of Classification Search

CPC ..... F02D 13/0234; F02D 13/0238; F02D 13/0226; F02D 2041/001; F01L 13/08; F01L 2800/09; F01L 1/344; F01L 1/34; F01L 13/0015; F01L 2013/0084; F01L 2800/14; F01L 2800/06

USPC ..... 123/90.15–90.18, 90.48

See application file for complete search history.

(56) References Cited

FOREIGN PATENT DOCUMENTS

| | | | |
|---|---|---|---|
| JP | 6-185321 | A | 7/1994 |
| JP | 10-2249 | A | 1/1998 |
| JP | 2012-197770 | A | 10/2012 |
| JP | 2013-124623 | A | 6/2013 |
| JP | 5434243 | B2 | 12/2013 |
| JP | 5582195 | B2 | 9/2014 |
| KR | 10-1999-0063947 | A | 7/1999 |
| KR | 10-2013-0063819 | A | 6/2013 |

*Primary Examiner* — Syed O Hasan

(74) *Attorney, Agent, or Firm* — Morgan, Lewis & Bockius LLP

(57) ABSTRACT

A control method using a continuous variable duration apparatus provided to adjust opening duration of an intake valve of an engine includes: determining a reduction amount of a compression ratio to prevent knocking, when knocking of an engine is expected, setting a desired effective compression ratio required for the reduction amount of the effective compression ratio, setting desired duration for the set desired effective compression ratio, and controlling duration of the intake valve on the basis of the set desired duration.

10 Claims, 9 Drawing Sheets

CONTINUOUS VARIABLE VALVE DURATION APPARATUS AND CONTROL METHOD USING THE SAME

CROSS-REFERENCE TO RELATED APPLICATION

The present application claims priority to and the benefit of Korean Patent Application No. 10-2014-0177810 filed on Dec. 10, 2014, the entire contents of which is incorporated herein for all purposes by this reference.

BACKGROUND OF THE INVENTION

Field of the Invention

The present invention relates to a continuous variable valve duration apparatus and a control method using the same. More particularly, the present invention relates to a continuous variable valve duration apparatus that can change opening duration of a valve with a simple configuration in accordance with operational states of an engine.

Description of Related Art

In general, internal combustion engines generate power by receiving and burning air and fuel in a combustion chamber. An intake valve is operated by a camshaft, and air is charged into the combustion chamber while the intake valve is open. An exhaust valve is also operated by the camshaft, and air is discharged from the combustion chamber while the exhaust valve is open.

Optimal operation of the intake valve/exhaust valve, however, depends on the RPM of the engine. That is, an appropriate time for lifting or opening/closing the valves depends on the RPM of the engine. In order to implement an appropriate valve operation in accordance with the RPM of the engine, as described above, a CVVL (Continuously Variable Valve Lift) apparatus that has a plurality of shapes of cams operating valves or operates valves at different lifts in accordance with the RPM of an engine has been studied.

A CVVT (Continuous Variable Valve Timing) technique has been developed to adjust the opening duration of a valve, in which the timing of opening/closing a valve are simultaneously changed with the valve duration being fixed.

However, the CVVL or the CVVT has a problem in that the configuration is complicated and the manufacturing cost is high. Meanwhile, there is a limit in preventing knocking of an engine using the CVVT.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus having advantages of being able to adjust duration of a valve lift in accordance with the operational states of an engine, and a control method using the continuous variable valve duration apparatus.

In an aspect of the present invention, a continuous variable duration apparatus may include a plurality of wheels that are mounted on a camshaft, wherein each wheel may include a wheel key and corresponds to cylinders, respectively, a plurality of cam device, wherein each cam device may include cams and a cam key, and the camshaft is inserted into the cams, and wherein the each cam device may have variable relative phases of the cams with respect to the camshaft and corresponding to the cylinders, respectively, a plurality of inner brackets that are connected to the wheel key and the cam key, a plurality of slider housings in which the inner brackets are rotatably inserted, wherein the slider housings are selectively movable vertically with respect to the engine, a controller that adjusts positions of rotational centers of the inner brackets by changing positions of the slider housings, and a guide device that guides the slider housings, wherein a compression ratio of the engine is controlled by controlling duration of a valve.

The apparatus may further include first pins having a wheel key slot in which the wheel key is slidably inserted, and second pins having a cam key slot in which the cam key is slidably inserted, wherein the inner brackets may have first and second pin holes in which the first pins and the second pins are inserted, respectively.

First and second pins may have the shape of a cylinder, and the first and second pins are rotatably inserted in the first and second pin holes.

The wheel key slot of the first pins and the cam key slot of the second pins are formed in opposite directions Control teeth are formed on a side of each of the slider housing, wherein the controller may include a control shaft that is in parallel with the camshaft and may have control gears engaged with the control teeth, and a motor that selectively rotates the control shaft.

The guide device may include a guide bar guiding the slider housings, and guide brackets fixing the guide bar, wherein a guide slot in which the guide bar is inserted is formed in the slider housings.

In another aspect of the present invention, a control method using a continuous variable duration apparatus provided to adjust opening duration of an intake valve of an engine, may include determining a reduction amount of an effective compression ratio to prevent knocking, when the knocking of the engine is expected, setting a desired effective compression ratio required for the reduction amount of the effective compression ratio, setting desired opening duration for the set desired compression ratio, and controlling the opening duration of the intake valve on a basis of the set desired opening duration.

The determining of the reduction amount of the compression ratio is performed on a basis of a current compression ratio of the engine and a map storing reduction amounts of a compression ratio corresponding to expected intensities of the knocking.

The expecting of the knocking of the engine is determined by detecting a change in position of an accelerator pedal.

The setting of the desired opening duration is performed on a basis of a map storing compression ratios for implementing the opening duration of the intake valve in a current state of the engine.

When the engine enters a normal operation state where the knocking is not expected, the method is ended.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
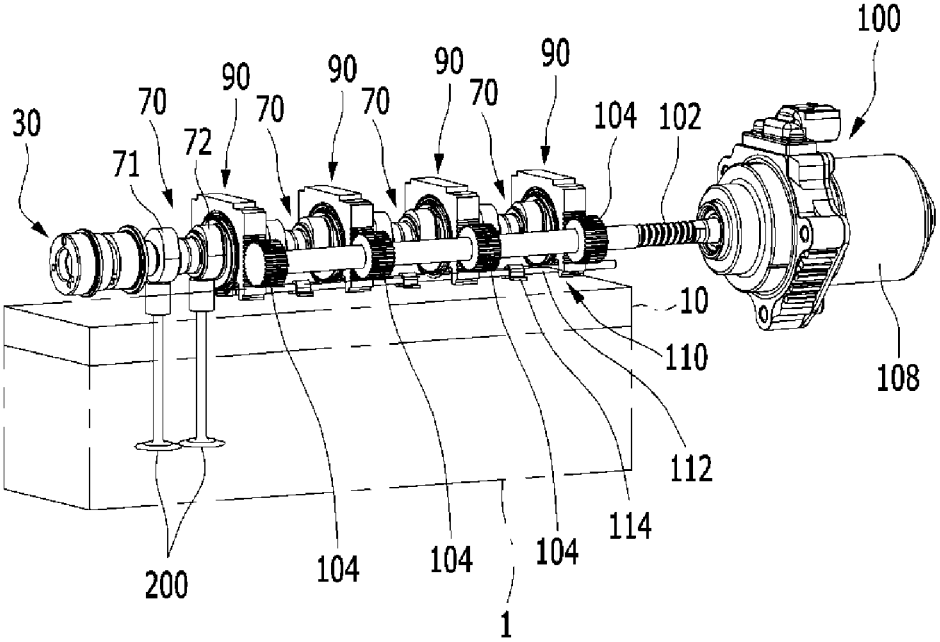
FIG. 1 is a perspective view an engine equipped with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention.

Like reference numerals are given to like components throughout the specification.

Throughout the specification, unless explicitly described to the contrary, the word "comprise" and variations such as "comprises" or "comprising" will be understood to imply the inclusion of stated elements but not the exclusion of any other elements.

An exemplary embodiment of the present invention will hereinafter be described in detail with reference to the accompanying drawings.

Figure 2:
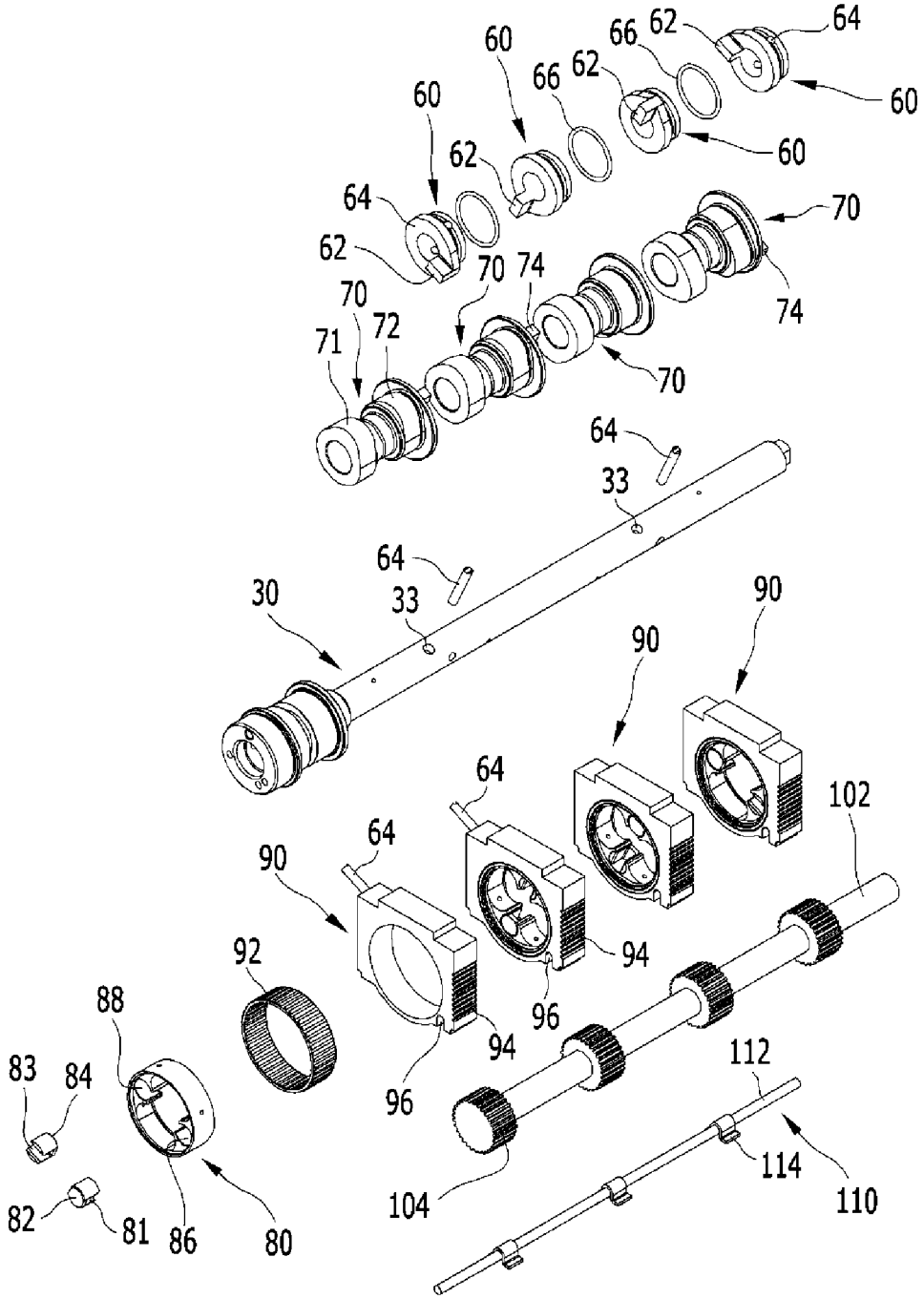
FIG. 2 is an exploded perspective view of the continuous variable valve duration apparatus according to an exemplary embodiment of the present invention.
Figure 3:
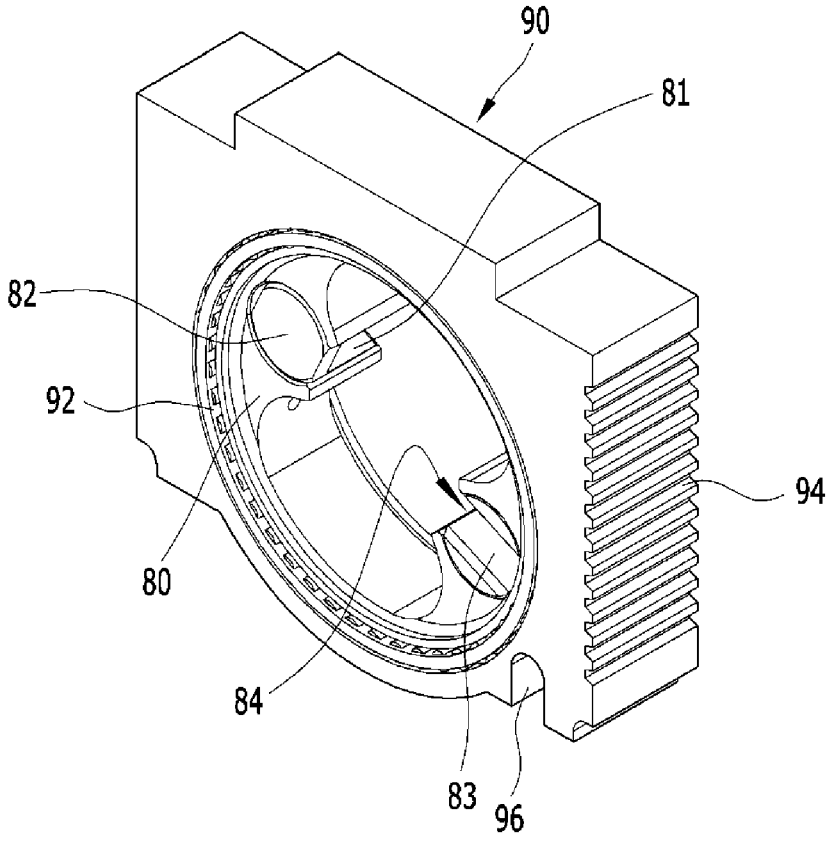
FIG. 3 and FIG. 4 are partial exploded perspective views of the continuous variable valve duration apparatus according to an exemplary embodiment of the present invention.
Figure 4:
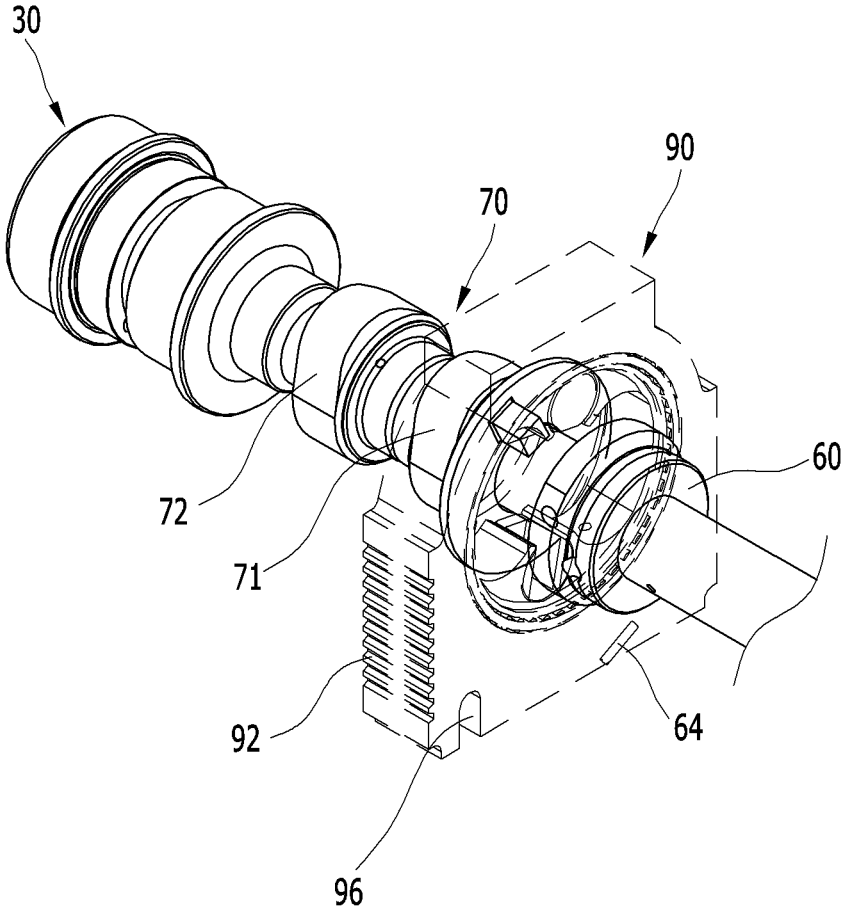

FIG. 1 is a perspective view an engine equipped with a continuous variable valve duration apparatus according to an exemplary embodiment of the present invention, FIG. 2 is an exploded perspective view of the continuous variable valve duration apparatus according to an exemplary embodiment of the present invention, and FIGS. 3 and 4 are partial exploded perspective views of the continuous variable valve duration apparatus according to an exemplary embodiment of the present invention.

Referring to FIGS. 1 to 4, an engine according to an exemplary embodiment of the present invention includes an engine block 1, a cylinder head 10 mounted on the engine block 1, and a continuous variable valve duration apparatus that is mounted on the cylinder head 10.

The continuous variable valve duration apparatus includes: a camshaft 30, a plurality of wheels 60 mounted on the camshaft 30, each having a wheel key 62, and corresponding to cylinders, respectively, a plurality of cam units 70 having cams 71 and 72 and a cam key 74, in which the camshaft 30 is inserted, that have variable relative phases of the cams 71 and 72 with respect to the camshaft 30, and correspond to the cylinders, respectively, a plurality of inner brackets 80 that are connected to the wheel keys 62 and the cam keys 74, a plurality of slider housings 90 in which the inner brackets 80 are rotatably inserted and that can move vertically with respect to the engine, a controller 100 that adjusts the positions of the rotational centers of the inner brackets 80 by changing the positions of the slider housings 90, and a guide unit 110 that guides the slider housings 90.

The camshaft 30 may be an intake camshaft or an exhaust camshaft.

Although two cams 71 and 72 are provided in the drawings, the present invention is not limited thereto.

The cams 71 and 72 open/close a valve 200.

Fastening holes 33 are formed at the camshaft 30, and the wheels 60 can be combined with the camshaft 30 by connecting pins 64. Coupling springs 66 are mounted on the wheels 60, so they can prevent separation of the connecting pins 64.

The continuous variable valve duration apparatus further includes first pins 82 having a sliding key slot 81 in which the wheel key 62 is slidably inserted and second pins 84 having a sliding key slot 83 in which the cam key 74 is slidably inserted, and the inner bracket 80 has first and second pin holes 86 and 88 in which the first pin 82 and the second pin 84 are inserted, respectively.

The first and second pins 82 and 84 have the shape of a cylinder and are rotatably inserted in the first and second pin holes 86 and 88.

Accordingly, since the first and second pins 82 and 84 and the first and second sliding pin holes 86 and 88 are formed in the shape of a cylinder, abrasion resistance can be improved.

Further, productivity can be secured by the simple shape of the first and second pins 82 and 84 and the first and second sliding pin holes 86 and 88.

The sliding key slots 81 and 83 of the first and second pins 82 and 84 are formed in opposite directions, and the wheel key 62 and the cam key 74 can be inserted therein.

The first and second pin holes 86 and 88 may be partially open in order to not interfere with movement of the wheel key 62 and the cam key 72.

A needle bearing 92 may be disposed between the slider housing 90 and the inner bracket 80, so the slider housing 90 and the inner bracket 80 can easily rotate relative to each other and rigidity can be secured.

Control teeth 94 is formed on a side of each of the slider housings 90, and the controller 100 includes a control shaft 102 that is parallel with the camshaft 30 and has control gears 104 engaged with the control teeth 94, and a motor 108 that selectively rotates the control shaft 102.

The guide unit 110 includes a guide bar 112 guiding the slider housings 90 and guide brackets 114 fixing the guide bar 112, and a guide slot 96 in which the guide bar 112 is inserted is formed in the slider housings 90.

Figure 5A:
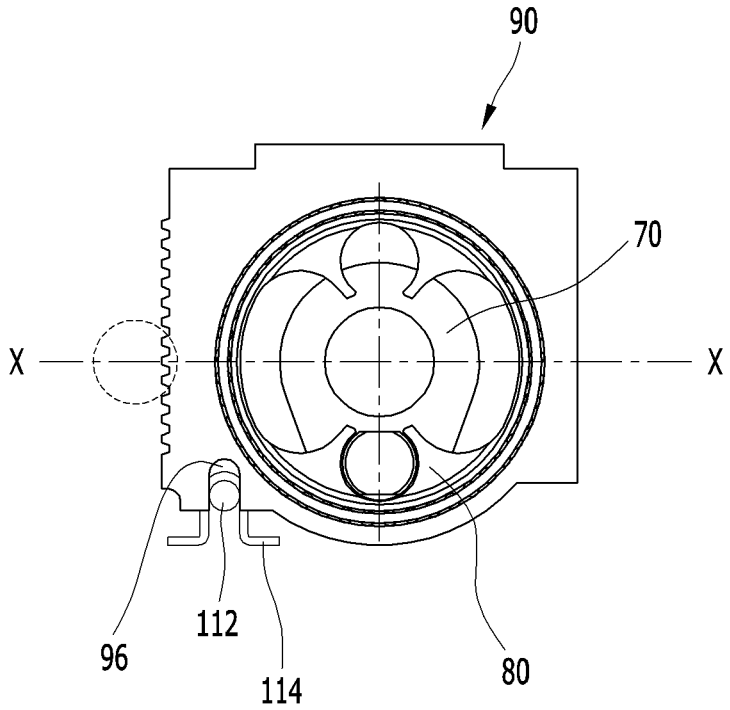
FIG. 5A, FIG. 5B and FIG. 5C are views illustrating the operation of the continuous variable valve duration apparatus according to an exemplary embodiment of the present invention.
Figure 5B:
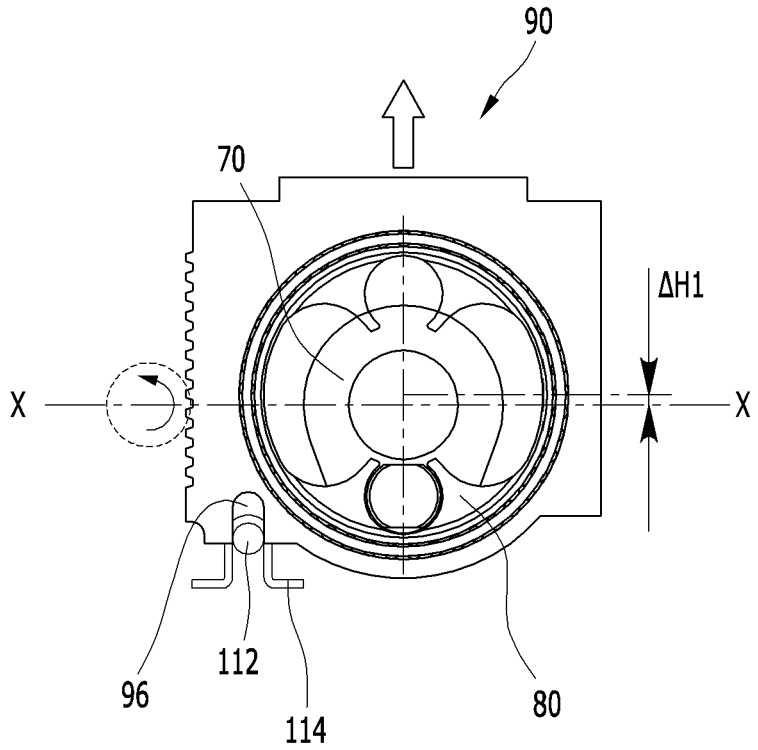
Figure 5C:
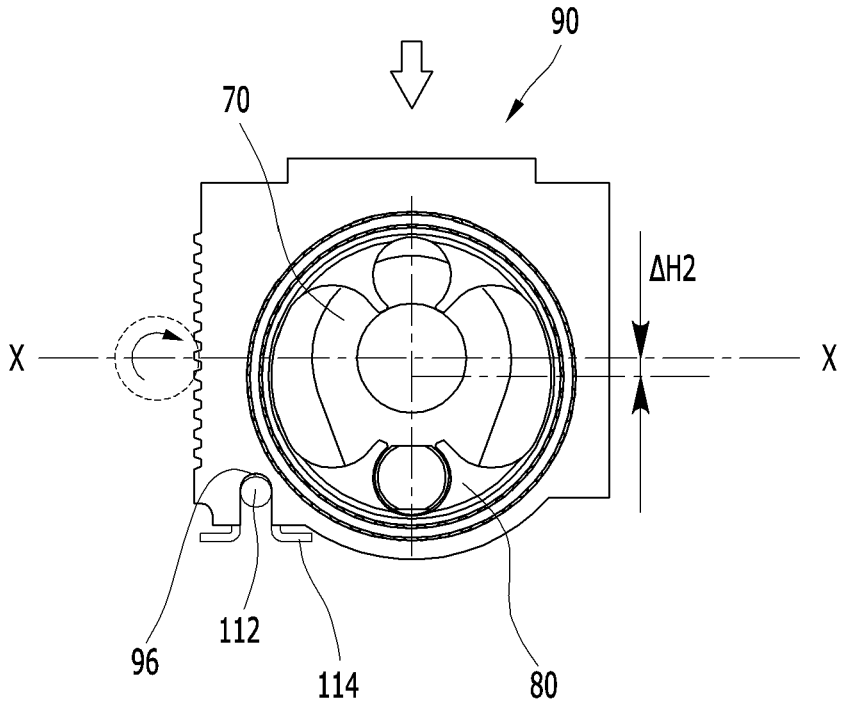
Figure 6:
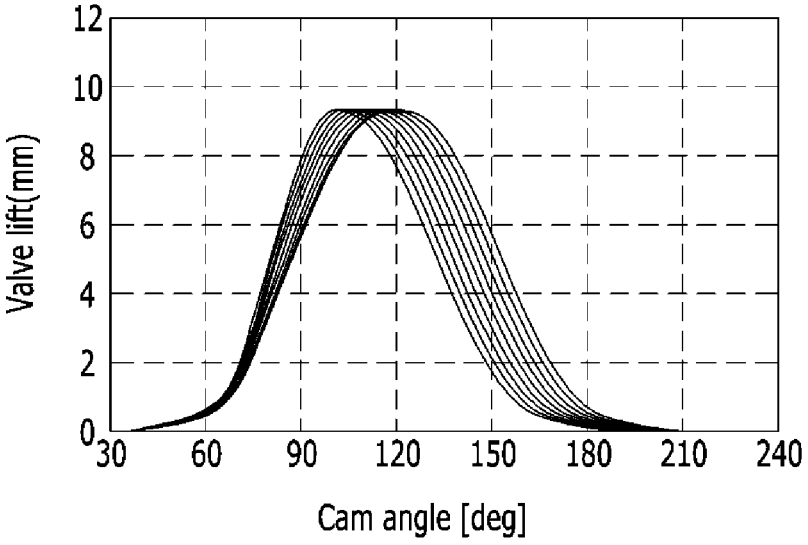
FIG. 6 is a graph showing a valve profile of the continuous variable valve duration apparatus according to an exemplary embodiment of the present invention.

FIG. 5 is a view illustrating the operation of the continuous variable valve duration apparatus according to an exemplary embodiment of the present invention, and FIG. 6 is a graph showing a valve profile of the continuous variable valve duration apparatus according to an exemplary embodiment of the present invention.

Hereinafter, the operation of the continuous variable valve duration apparatus according to an exemplary embodiment of the present invention is described with reference to FIGS. 1 to 6.

In accordance with the operational states of an engine, the motor 108 of the controller 100 operates and changes the relative positions of the slider housings 90.

For example, in (a) of FIG. 5, as the motor 108 operates, the control shaft 102 rotates, so when the position of the slider housing 90 changes upward, the rotational center of the inner bracket 80 moves by ΔH1, as in (b) of FIG. 5, or when the position of the slider housing 90 changes downward, the rotational center of the inner bracket 80 moves by ΔH2, as in (c) of FIG. 5.

As the position of the rotational center of the inner bracket 80 changes, the rotational acceleration of the cam unit 70 changes and valve duration changes accordingly.

As shown in FIG. 6, the maximum lift of the valve 200 is constant, and as the position of the slider housing 90 changes, the relative rotational speed of the cams 71 and 72 to the camshaft 30 changes, the timing for opening/closing the valve 200 change, and accordingly, the duration of the valve 200 changes. In order to control an effective compression ratio of an engine, it may be possible to adjust duration to change the timing of closing an intake valve while maintaining an MBT (Minimum spark advance for Best Torque) where the maximum torque is obtained. The duration is controlled by the motor 108, and accordingly, responsiveness can be secured.

Figure 7:
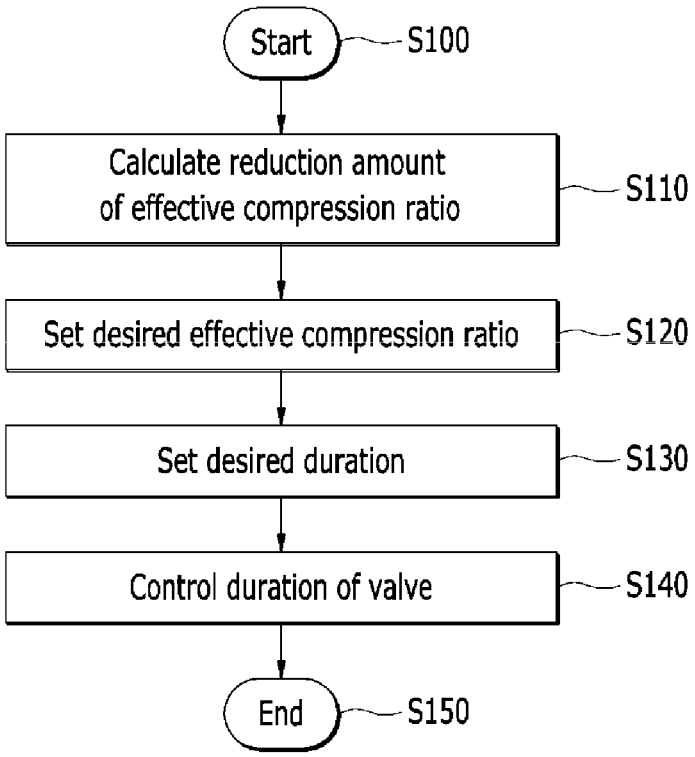
FIG. 7 is a flowchart illustrating a control method using the continuous variable valve duration apparatus according to an exemplary embodiment of the present invention.

FIG. 7 is a flowchart illustrating a control method using the continuous variable valve duration apparatus according to an exemplary embodiment of the present invention.

As illustrated in FIG. 7, a control method using the continuous variable valve duration apparatus according to an exemplary embodiment of the present invention is used to prevent knocking of an engine and improve acceleration ability and deceleration ability of a vehicle by controlling an effective compression ratio when the amount of air flowing into the engine changes too much due to rapid operation of an accelerator pedal.

When knocking of an engine due to rapid operation of an accelerator pedal is expected (S100), an ECU (Electronic Control Unit) calculates a reduction amount of an effective compression ratio that can prevent knocking of the engine (S110). The expectation of knocking of an engine may be performed by detecting a change in position of an accelerator pedal. The ECU is a common system mounted on vehicles to generally control electronic devices in the vehicles and is well known to those skilled in the art, so the detailed description is not provided.

The calculation of a reduction amount of an effective compression ratio (S110) may be performed on the basis of the current compression ratio of an engine and a map storing reduction amounts of an effective compression ratio corresponding to expected intensities of knocking. The map of reduction amounts of an effective compression ratio may be designed by those skilled in the art and stored in the ECU.

When the required reduction amount of the effective compression ratio is calculated, a desired effective compression ratio is set on the basis of it (S120). The reduction amount of an effective compression ratio is the magnitude of a compression ratio that should be lowered to achieve a desired effective compression ratio from the current compression ratio of an engine.

When the desired effective compression ratio is set (S120), the ECU sets desired duration for achieving the set desired effective compression ratio (S130). The setting of desired duration according to the desired effective compression ratio (S130) may be performed on the basis of the current speed of an engine and a map storing effective compression ratios for implementing duration of the valve 200 in accordance with intake and exhaust timings. The map of the relationship between duration of the valve and an effective compression ratio may be designed by those skilled in the art and stored in the ECU.

When the desired duration is set (S130), the controller 100 controls the duration of the valve 200 on the basis of the set desired duration (S140). The valve 200 of which the duration is controlled may be an intake valve. As the duration of the valve 200 is controlled, an engine is operated without knocking even if an accelerator pedal is rapidly operated. Further, when an engine enters a normal operation state where knocking is not expected, the control method using a continuous variable valve duration apparatus according to an exemplary embodiment of the present invention is ended (S150). The normal operation state of an engine is determined by the ECU receiving information about the operation state of the engine.

As described above, according to the continuous variable valve duration apparatus according to an exemplary embodiment of the present invention, it is possible to adjust duration of a valve lift with a simple configuration in accordance with the operational states of an engine. Further, it is possible to apply the continuous variable valve duration apparatus even without excessive design change of existing common engines, so it is possible to increase productivity and reduce the manufacturing cost. Further, it is possible to control an effective compression ratio of an engine by adjusting duration of a valve lift.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable duration apparatus comprising:

a plurality of wheels that are mounted on a camshaft, wherein each wheel includes a wheel key and corresponds to cylinders, respectively;

a plurality of cam devices, wherein each of the cam devices includes cams and a cam key, and the camshaft is inserted into the cams, and wherein the cam devices have variable relative phases of the cams with respect to the camshaft and corresponding to the cylinders, respectively;

a plurality of inner brackets that are connected to the wheel key and the cam key;

a plurality of slider housings in which the inner brackets are rotatably inserted, wherein the slider housings are selectively movable vertically with respect to the engine;

a controller that adjusts positions of rotational centers of the inner brackets by changing positions of the slider housings; and a guide device that guides the slider housings, wherein a compression ratio of the engine is controlled by controlling duration of a valve by adjusting the relative phases of the cams, wherein control teeth are formed on a side of each of the slider housings, and wherein the controller includes:

a control shaft that is in parallel with the camshaft and has control gears engaged with the control teeth; and an actuator that selectively rotates the control shaft.

2. The apparatus of claim 1, further comprising:

first pins having a wheel key slot into which the wheel key is slidably inserted; and second pins having a cam key slot into which the cam key is slidably inserted, wherein the inner brackets have first and second pin holes into which the first pins and the second pins are inserted, respectively.

3. The apparatus of claim 2, wherein the first and second pins have a shape of a cylinder, and the first and second pins are rotatably inserted into the first and second pin holes.

4. The apparatus of claim 3, wherein the wheel key slot of the first pins and the cam key slot of the second pins are formed in opposite directions.

5. The apparatus of claim 1, wherein the guide device includes:

a guide bar guiding the slider housings; and guide brackets fixing the guide bar, wherein a guide slot is formed in the slider housings, and wherein the guide bar is inserted in the guide slot.

6. A control method using a continuous variable duration apparatus provided to adjust opening duration of an intake valve of an engine, the method comprising:

determining, by a controller, a reduction amount of a compression ratio to prevent knocking, when the knocking of the engine is expected;

setting, by the controller, a desired compression ratio required for the reduction amount of the compression ratio;

setting, by the controller, a desired opening duration for the set desired compression ratio; and controlling, by the controller, the opening duration of the intake valve on a basis of the set desired opening duration, wherein the continuous variable duration apparatus includes:

a plurality of wheels that are mounted on a camshaft, wherein each wheel includes a wheel key and corresponds to cylinders, respectively;

a plurality of cam devices, wherein each of the cam devices includes cams and a cam key, and the camshaft is inserted into the cams, and wherein the cam devices have variable relative phases of the cams with respect to the camshaft and corresponding to the cylinders, respectively;

a plurality of inner brackets that are connected to the wheel key and the cam key;

a plurality of slider housings in which the inner brackets are rotatably inserted, wherein the slider housings are selectively movable vertically with respect to the engine;

a controller that adjusts positions of rotational centers of the inner brackets by changing the positions of the slider housings; and a guide device that guides the slider housings, wherein a compression ratio of the engine is controlled by controlling duration of a valve by adjusting the relative phases of the cams.

7. The method of claim 6, wherein the determining of the reduction amount of the compression ratio is performed on a basis of a current compression ratio of the engine and a map storing reduction amounts of a compression ratio corresponding to expected intensities of the knocking.

8. The method of claim 6, wherein the expecting of the knocking of the engine is determined by detecting a change in position of an accelerator pedal.

9. The method of claim 6, wherein the setting of the desired opening duration is performed on a basis of a map storing compression ratios for implementing the opening duration of the intake valve in a current state of the engine.

10. The method of claim 6, wherein when the engine enters a normal operation state where the knocking is not expected, the method is ended.

* * * * *